US005496426A

United States Patent [19]

Murtha

[11] Patent Number: 5,496,426

[45] Date of Patent: Mar. 5, 1996

[54] ALUMINUM ALLOY PRODUCT HAVING GOOD COMBINATIONS OF MECHANICAL AND CORROSION RESISTANCE PROPERTIES AND FORMABILITY AND PROCESS FOR PRODUCING SUCH PRODUCT

[75] Inventor: Shawn J. Murtha, Monroeville, Pa.

[73] Assignee: Aluminum Company of America, Pittsburgh, Pa.

[21] Appl. No.: 278,380

[22] Filed: Jul. 20, 1994

[51] Int. Cl.[6] ..... C22F 1/04

[52] U.S. Cl. ..... 148/691; 148/692; 148/693; 148/694; 148/701; 148/417; 148/418; 148/439; 420/532

[58] Field of Search ..... 148/691, 692, 148/693, 694, 701, 417, 418, 439; 420/532

[56] References Cited

U.S. PATENT DOCUMENTS

| | | | |
|---|---|---|---|
| 2,248,185 | 7/1941 | Nock | 148/701 |
| 3,198,676 | 8/1965 | Sprowls et al. | 148/417 |

(List continued on next page.)

FOREIGN PATENT DOCUMENTS

| | | |
|---|---|---|
| 58-061246 | 4/1983 | Japan . |
| 58-113342 | 7/1983 | Japan . |
| 60-013047 | 1/1985 | Japan . |
| 60-180637 | 9/1985 | Japan . |
| 61-238937 | 10/1986 | Japan . |
| 61-259828 | 11/1986 | Japan . |
| 62-063641 | 3/1987 | Japan . |
| 62-142753 | 6/1987 | Japan . |
| 346369 | 11/1970 | U.S.S.R. . |
| 473759 | 10/1975 | U.S.S.R. . |
| 1476942 | 6/1977 | United Kingdom . |
| 1480351 | 7/1977 | United Kingdom . |

OTHER PUBLICATIONS

"Precipitation Hardening and Stress Corrosion in $AlZnMg_3$", W. Gruhl et al, *Z. Metallkunde,* vol. 55, No. 10, pp. 577–582 (1964).

"Thermomechanical Treatments on High Strength Al–Zn–Mg(—Cu) Alloys", E. DiRusso et al, *Metallurgical Tansactions,* vol. 4, pp. 1133–1144 (Apr. 1973).

(List continued on next page.)

*Primary Examiner*—David A. Simmons
*Assistant Examiner*—Robert R. Koehler
*Attorney, Agent, or Firm*—Carl R. Lippert

[57] ABSTRACT

An improved high strength aluminum alloy product having good combinations of strength, toughness, corrosion resistance and the ability to be subjected in sheet or strip form to roll forming or shaping operations to produce elongate stringer or other aerospace structural reinforcing members. The alloy consists essentially of about 7.6 to 8.4% zinc, about 1.8 to 2.2% magnesium, about 2 to 2.6% copper and at least one element selected from zirconium, vanadium and hafnium present in a total amount not exceeding about 0.5%, preferably about 0.05 to 0.25% zirconium, the balance aluminum and incidental elements and impurities. The improved strip is preferably produced by homogenizing, hot rolling and thermally treating or annealing at about 750° to 850° F., preferably around 800° F., followed by cold rolling to a reduction in thickness of between about 20 and 50 or 60%, preferably in the neighborhood of about 25 to 35% which, in turn, is followed by a two-stage thermal annealing treatment including heating, preferably within about 650° to about 700° F. followed by controlled cooling or ramping down to one or more temperatures within preferably around 425° to 475° F. The sheet or strip so produced can be taper rolled to vary the thickness along the length of the strip which, following such taper rolling, if employed, is preferably solution heat treated and quenched, straightened, roll shaped in a plurality of roll shaping operations to produce a structural shape cross section which is then artificially aged to develop the desired properties for the aerospace application.

29 Claims, 3 Drawing Sheets

U.S. PATENT DOCUMENTS

| | | | |
|---|---|---|---|
| 3,231,435 | 1/1966 | Rotsell et al. | 148/417 |
| 3,287,185 | 11/1966 | Vachet et al. | 148/417 |
| 3,305,410 | 2/1967 | Sublett et al. | 148/417 |
| 3,563,814 | 2/1971 | Lyle et al. | 148/417 |
| 3,645,804 | 2/1972 | Ponchel | 148/701 |
| 3,791,876 | 2/1974 | Kroger | 148/417 |
| 3,836,405 | 9/1974 | Staley et al. | 148/417 |
| 3,856,584 | 12/1974 | Cina | 148/701 |
| 3,881,966 | 5/1975 | Staley et al. | 148/417 |
| 3,945,861 | 3/1976 | Anderson et al. | 148/693 |
| 3,947,297 | 3/1976 | Reimann et al. | 148/417 |
| 4,063,936 | 12/1977 | Nagase et al. | 420/532 |
| 4,069,072 | 1/1978 | Develay et al. | 148/439 |
| 4,126,448 | 11/1978 | Moore et al. | 420/532 |
| 4,189,334 | 2/1980 | Dubost et al. | 148/417 |
| 4,193,822 | 3/1980 | Adam et al. | 148/417 |
| 4,200,476 | 4/1980 | Dubost et al. | 148/417 |
| 4,305,763 | 12/1981 | Quist et al. | 148/417 |
| 4,345,951 | 8/1982 | Coupry et al. | 148/417 |
| 4,431,467 | 2/1984 | Staley et al. | 148/417 |
| 4,477,292 | 10/1984 | Brown | 148/417 |
| 4,629,517 | 12/1986 | Lifka et al. | 148/415 |
| 4,732,610 | 3/1988 | Hildeman et al. | 420/532 |
| 4,828,631 | 5/1989 | Ponchel et al. | 148/417 |
| 4,832,758 | 5/1989 | Brown | 148/417 |
| 4,863,528 | 9/1989 | Brown et al. | 148/417 |
| 4,954,188 | 9/1990 | Ponchel et al. | 148/417 |
| 5,221,377 | 6/1993 | Hunt, Jr. et al. | 148/417 |

OTHER PUBLICATIONS

"New Technique for Reducing Susceptibility to Stress–Corrosion of High Strength Aluminum Alloys", B. Cina et al, Published by the Pittsburgh Chapter of the American Society for Metals (1974).

"A New Approach to the Problem of Stress Corrosion Cracking in 7075–T6 Aluminum", W. Wallace et al, *Canadian Aeronautics and Space Journal,* vol. 27, No. 3, pp. 222–232 (1981).

"Microstructural Study of a High–Strength Stress–Corrosion Resistant 7075 Aluminum Alloy", K. Rajan et al, *Journal of Materials Science,* vol. 17, pp. 2817–2824 (1982).

"Retrogression and reaging response of 7475 aluminum alloy", M. U. Islan et al, *Metals Technology,* vol. 10, pp. 386–392 (Oct. 1983).

Report: "Investigation to Improve the Stress–Corrosion Resistance of Aluminum Aircraft Alloys Through Alloy Additions and Specialized Heat Treatment", J. T. Staley, under Navair N00019–68–C–0146 (Navair Report).

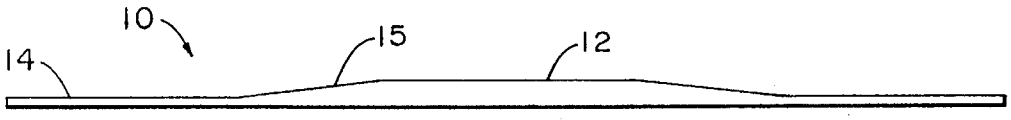
FIG. 1(a)
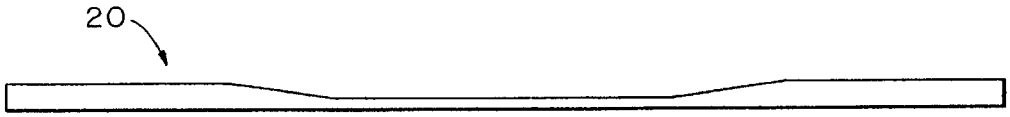
FIG. 1(b)
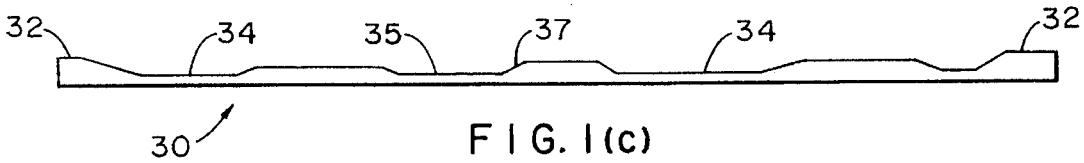
FIG. 1(c)
FIG. 2(a)
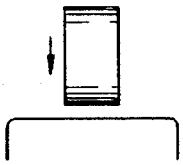
FIG. 2(b)
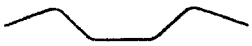
FIG. 2(c)
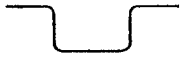
FIG. 2(d)
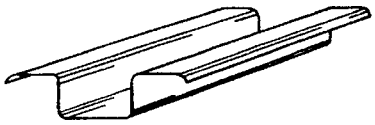
FIG. 2(e)

ALUMINUM ALLOY PRODUCT HAVING GOOD COMBINATIONS OF MECHANICAL AND CORROSION RESISTANCE PROPERTIES AND FORMABILITY AND PROCESS FOR PRODUCING SUCH PRODUCT

BACKGROUND

The present invention relates to making an aluminum alloy product having improved combinations of strength, toughness and corrosion resistance, together with good formability in the form of a rolled sheet or strip product such that elongate sheet structural section airframe members, such as stringers and frames, can be roll formed from such strip.

Currently, aluminum alloy sheet or strip products are roll formed into elongate aerospace structural shape members, such as stringers, that run lengthwise along an airplane fuselage to reinforce the fuselage. A typical elongate stringer may have a hat-like cross-section shape achieved by the roll forming process. In some cases, the sheet or strip product is first taper rolled along its length to provide thinner portions at select locations along the length tapering back to the original thicker sheet or strip thickness. The tapering between thicker and thinner regions then again can occur several times along the length of the stringer. Typically, the thicker portions of the taper rolled strip can be aligned with fastener regions to provide the desired ruggedness and strength at the fastening site. After the taper rolling, the hat-like shape is roll formed from the multiple or dual thickness strip material to make the elongate stringer. In some cases, taper rolling is omitted. The roll forming operation is a serious formability operation when dealing with the high strength materials needed for aerospace application, especially if the taper rolling operation just referred to precedes roll forming.

The taper rolling operation itself can produce serious stresses in the material since the taper rolling can involve reductions of up to 50% to 70% or so in a single rolling pass which can result in serious degrees of edge cracking in the thinner rolled areas along the length. The edge cracking, as a minimum, creates more scrap by trimming or, more seriously, can result in scrapping an entire member.

The material presently used for many stringer applications in commercial airliner construction is 7075 alloy, usually processed to enhance formability, which after roll shaping is artificially aged to a T6 temper in which it has fairly high strength, which typically can be around 81 or 82 or 83 ksi ultimate longitudinal strength and around 73 or 74 ksi longitudinal tension yield strength so as to be useful in the application, but the 7075-T6 product is characterized by only moderate L-T fracture toughness of around 70 to 100 ksi$\sqrt{\ }$ in $K_c$ and by some susceptibility to stress corrosion cracking.

While the final temper of the product may be T6 temper, the forming operation is normally performed in an annealed temper, normally referred to as the "0" temper, or in a "W" temper which is solution heat treated, quenched and then refrigerated so as to reduce the natural aging strength increase and retain a suitable level of formability. Normally, the "0" temper is desired where taper rolling is employed so as to reduce edge cracking, but it is advantageous even if starting with the "0" temper to convert to the "W" temper by solution heat treating and quenching after taper rolling, if employed, and before roll shaping a stringer because a stringer made from roll formed "W" material will be less distorted than one made from "0" temper material and solution treated after shaping since rapid quenching after solution heating can cause significant amounts of distortion of the shaped stringer.

It is to be appreciated that, except as indicated otherwise herein, alloy designations (such as 7075) and temper designations (such as T6, 0, W) refer to the Aluminum Association designations in Aluminum Standards and Data and the Registration Records, all published by the Aluminum Association and all fully incorporated herein by reference.

As stated above, the present materials used in stringer and other roll formed applications leave considerable room for improvement, and it would be desirable to have a material which could substantially equal or possibly exceed the strength of 7075-T6 and combine that strength with a higher level of fracture toughness and corrosion resistance while not suffering from reduced formability as compared to 7075 alloy. For instance, 7075-T6 has typical stress corrosion cracking (SCC) resistance of 15 to possibly 25 ksi thresholds (no failures after 40 days' alternate immersion (AI) testing) at that stress level using ASTM G64, G44 test procedures. It would be desirable to achieve SCC thresholds of 30 to 35 ksi while not degrading other properties.

SUMMARY OF THE INVENTION

A principal object of the invention is to provide aluminum alloy products having high strength, high toughness and corrosion resistance properties, together with sufficient forming characteristics, to enable forming stringers by roll shaping which may or may not be preceded by taper rolling.

These and other objects of the invention are achieved using an alloy consisting essentially of about 7.6 to 8.4% zinc, about 1.8 to 2.3% magnesium, about 2 to 2.6% copper, and at least one element selected from zirconium, vanadium and hafnium present in an amount up to about 0.2% or 0.3% for zirconium and vanadium or about 0.4 or 0.5% for hafnium, the balance being essentially aluminum and incidental elements and impurities. The alloy may be benefitted in some cases with up to about 0.3 or 0.4% manganese. As used herein, all compositional limits are by weight percent unless otherwise indicated. The aforesaid alloy is described generally in U.S. Pat. No. 5,221,377, issued Jun. 22, 1993 and presently assigned to the Aluminum Company of America, the entire content of said U.S. Pat. No. 5,221,377 being incorporated fully herein by reference. The alloy may possibly further contain, by way of incidental elements, elements such as silver, scandium, germanium, tungsten, tin, indium or other elements includable in aluminum, but preferably present less than 0.5 or 1%, more preferably not over 0.1 or 0.2%, that may enhance the alloy for a given purpose without departing from the general scope of the invention in producing improved formidable material for making aircraft stringers and other roll shaped elongate members.

The improved alloy products in accordance with the invention are benefitted by a process in accordance herewith including hot rolling, annealing under controlled conditions, followed preferably by cold rolling within a preferred cold reduction range which is, in turn, preferably followed by controlled annealing, as described herein, all of which combine to produce a rolled sheet or strip product having good characteristics for cold taper rolling, where cold taper rolling is desired, and characterized by good roll shaping characteristics in either an annealed condition or in the preferred "W" temper condition.

BRIEF DESCRIPTION OF THE DRAWINGS

FIG. 1(*a*) to 1(*c*) is a schematic elevation along the length of a taper rolled strip showing regions of different thicknesses along the length of the strip or sheet, the differences being shown somewhat exaggerated and not to scale relative to the length of the metal;

FIG. 2(*a*) to 2(*e*) is a schematic representation of a forming sequence to make a hat-shaped structural section starting with a flat sheet or strip.

DETAILED DESCRIPTION OF PREFERRED EMBODIMENTS

Figure 3:
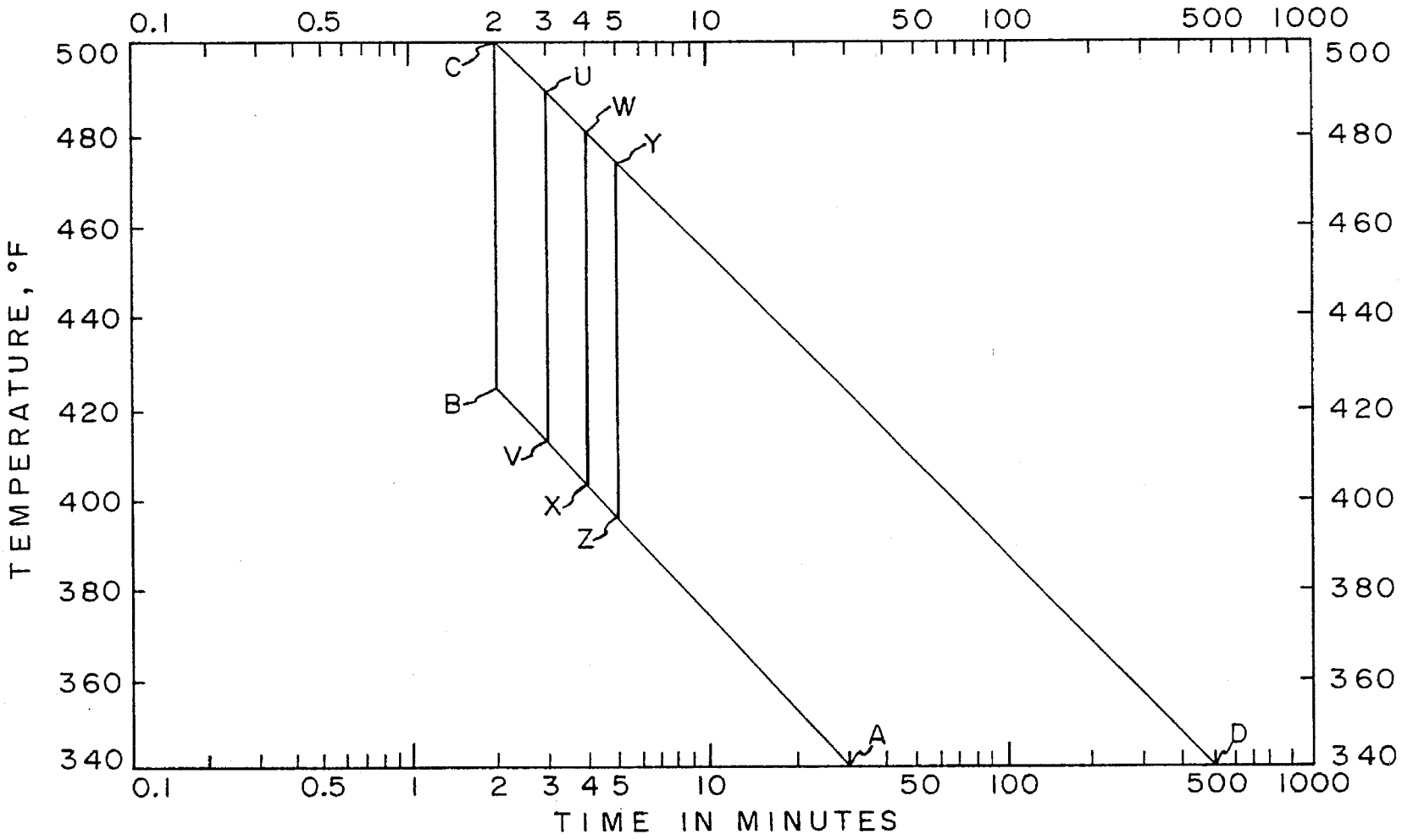
FIG. 3 is a temperature-time graph for an artificial aging treatment phase.

Examples of the kind of thickness variations along the length of a strip intended to be roll shaped into a stringer or other elongate structural member are depicted in FIG. 1, all of which are elevations along the length of a strip such as a 5-inch wide strip which may be around 20 to 40 feet long or longer showing the differences in thickness along the length of the strip. For instance, in FIG. 1(*a*), the strip 10 is thicker in the middle 12 than at each end 14, there being a gradual taper 15 from the thicker middle to the thinner parts at each end along the length of the strip. In FIG. 1 (*b*), on the other hand, the thicker portions are at each end with the middle region being cold roll tapered down to a thinner thickness. In FIG. 1(*c*), the taper rolling is more complicated and produces a much more complicated thickness profile along the length of the strip wherein end regions 32 are in the initial strip thickness, for instance around 0.17 inch, and thinner regions 34 can be around 0.07 inch thick. A region 35 along the length can be gradually tapered as shown. The different thickness regions have slopes or tapers between them, such as slopes 37. It is again emphasized that the variations shown in FIG. 1(*a*), (*b*) and (*c*) are thickness, not width, variations along the length of an elongate strip and are produced by cold roll tapering. It is significant that the thicker regions can vary from about 0.05 to about 0.2 inch, more commonly around 0.07 to about 0.18 inch, typically around 0.09 to about 0.16 or 0.17 inch, and generally correspond to the starting thickness of the strip material prior to roll tapering. It is also significant that the difference between the thinnest and thickest portion can be quite substantial, for instance, the thinner portion in some cases may be only 30 or 35% of the starting thickness retained in the thicker portion.

It is generally known that sheet metal products, such as aluminum sheet, can be stiffened by rolling a structural shape from the flat sheet product. One of the most simple examples would be corrugated or V-rib rolled sheet such as commonly used for building walls and roof members. Metal strip can be rolled into any of a number of shapes, such as hat shapes, "J" shapes, "Z" shapes, or any form desired to provide a structural stiffening cross section as is known in the art. A typical sequence for forming a "hat" structural cross-sectional shape is shown schematically in FIG. 2 wherein the metal thickness is represented by a single line, it being remembered that if the metal is roll tapered to include different thicknesses along its length, the thickness represented schematically by single lines in FIG. 2 would be thicker or thinner depending on where along the length the thickness is observed. For instance, in a stringer shaped from the roll tapered strip shown in FIG. 1(*a*), the thickness of the metal would be greater in the middle regions of the strip than on the end regions. Whether or not the metal strip is first roll tapered, it is roll shaped into a structural cross-section shape using known sheet beam rolling techniques. In the example shown in FIG. 2, the sequence progresses from (a) to (e) and ends with the hat shape depicted in FIG. 2(*e*). FIG. 2 is a rough schematic with metal thickness shown as a single line with each view showing the width (end view) of the elongate sheet, except for FIG. 2(*e*) which schematically illustrates the hat shape structural stringer in an isometric sense. In FIG. 2, it can be seen that the initially flat strip width as shown in (a) is first roll formed to make a generally channel-shaped section shown schematically in FIG. 2(*b*). The process could stop here with a channel-shaped beam section used as a stiffener. However, the process can continue such as along lines shown in FIG. 2 wherein the channel of (b) is converted into something of a "W" or "M" section, as depicted in (c), by the application of a roller force as generally schematically depicted in (b). The shape depicted at FIG. 2(*c*) could conceivably be used as a stiffener, but it is more likely that the process would continue to make a generally hat-shaped section, as shown in (d), which is refined by roll curling the edges, as shown in (e), which represents the final sheet roll-shaped structural shape having a hat-type structural cross section. It is to be remembered that all of the roll shaping involved in converting the flat width depicted in (a) of FIG. 2, which could be a 5-inch width, that ultimately leads to (e) of FIG. 2 along a shaped strip or stringer that can be 20 or 30 or 40 feet long, is by cold roll shaping operations. It is obviously important that the material not crack or break during these forming operations.

By a strip-derived structural shape is meant that the strip is shaped into a structural or beam cross-sectional structural shape such as shown in FIG. 2(*e*) along its length, it being kept in mind that such structural cross-sectional shapes could include "L" shapes, "J" shapes, "hat" shapes, "Z" shapes, or any roll formed cross-sectional structural shape, it being generally recognized in the art that roll shaped structural parts can be provided in a number of cross-sectional structural configurations. The structural member is referred to as elongate and can be as long as 10 to 40 feet or more in length. The length can be, and often is, substantially straight or it can be slightly bowed or it can be curved or arcuate.

As stated earlier, it can be preferable to perform the roll tapering operations leading to the different thicknesses along the length of the strip, such as shown in FIG. 1, in an essentially "0" or annealed temper whereas it can be better to perform the roll shaping operation such as generally illustrated in FIG. 2 in a "W" temper, i.e. a temper that is solution heat treated, quenched and normally refrigerated to retard natural aging strength gain. It is also worth remembering that each operation, roll tapering if employed, or roll shaping, can place a substantial stress on the material. If roll shaping is used after roll tapering, the forming stresses will normally be higher than the forming stresses if roll tapering is omitted prior to roll shaping. That is, starting the roll shaping sequence of FIG. 2 with a strip of constant thickness along its length is an easier operation than performing it with a strip of different thicknesses along its length. In any case, the shaping and rolling operations are demanding on the material, and in pursuing a higher strength, higher toughness material, it is important that the room temperature formability aspects be sufficient to permit the desired forming and avoid excessive rejection rates. As stated earlier, once the structural shape is achieved and is straightened or contoured, if desired, it is then artificially aged to develop the desired strength level for its use as an aircraft member.

As stated above, the alloy in accordance with the invention principally contains about 7.6 to 8.4% zinc, about 1.8 to 2.3% magnesium, about 2 to 2.6% copper, at least one element selected from zirconium, vanadium and hafnium present in an amount up to about 0.2 or 0.3% for zirconium and vanadium or about 0.4 or 0.5% hafnium, the alloy further including in some cases up to about 0.3 or possibly 0.4% manganese. For greater toughness values, the amount of magnesium can be preferably kept at or below about 2 or 2.1%. For better resistance to exfoliation and stress corrosion cracking, copper content should be maintained preferably at or above about 2.2%. The total amount of zinc, magnesium and copper present preferably should not substantially or excessively exceed a dissolvable amount, by which is meant an amount that can be brought substantially into solid solution during solution heat treatment (SHT) so that fewer than one or two volume percent (preferably less than one volume percent) of undissolved intermetallic phases about one micron in size or larger, and containing Zn, Cu and/or Mg, remains after solution heat treatment. On a more preferred basis, less than one-half volume percent of such undissolved phases should remain after SHT. It is therefore advantageous to limit combined zinc, magnesium and copper contents to between about 11.9 or 12.1% and about 12.5 or 12.7 or 12.9%. The invention alloy preferably should also contain a total zinc plus copper content between about 9.9 and 10.6 or 10.7%.

The alloy in accordance with the invention should also include at least one element selected from zirconium between about 0.03 and 0.2 or 0.3%, for instance 0.05 to 0.15 or 0.2 or 0.25% zirconium; vanadium between about 0.05 and 0.2 or 0.3%, for instance about 0.05 to 0.15% vanadium; and hafnium between about 0.03 and 0.4 or 0.5%, for instance about 0.05 to 0.35% hafnium. The alloy can also contain some manganese suitably between about 0.07 or 0.1 to about 0.3 or 0.35%. The total content of Zr, V, Hf and Mn should not exceed about 0.5 or 0.6 or 0.7%, and preferably the total amount does not exceed that amount which may substantially be maintained in a supersaturated state following alloy solidification. It is believed that such elements, or combinations of elements, enhance alloy performance such as by suppressing recrystallization to some extent, especially in cases where the alloy is subjected to cold work or equivalent cold work prior to solution heat treatment. Relatively high amounts of Zr within the aforesaid ranges, for instance 0.15 to 0.25 or even 0.3%, are believed to have benefit or potential benefit by reducing recrystallization in products whose production process might otherwise encourage or increase recrystallization tendency. It is neither necessary nor advantageous or sufficient for the invention alloy composition to include any nickel, calcium or chromium. The products in accordance with the invention exhibiting greater combinations of properties hereunder are substantially nickel-free, calcium-free and chromium-free. By use of the term "substantially free" as just used, such is meant that preferably no quantity of such elements is present, it being understood, however, that alloying materials, operating conditions and equipment are not always ideal such that minor amounts of undesirable contaminants or non-added elements may find their way into the invention alloy. In any event, it should be understood that the nickel content of the invention alloy is maintained below about 0.04 or 0.05%, or more preferably below a maximum of about 0.01 or 0.02% nickel; the calcium content should be kept below about 0.015 or 0.02%, more preferably below about 0.01 or 0.005% maximum; and the chromium level should be less than about 0.08%, or more preferably below a maximum of about 0.04 or 0.05% chromium.

It is preferable to also control the amount of impurities in the alloy for the invention. Although total iron plus silicon contents of about 0.2 or 0.25% maximum are preferred, it is also possible for the invention alloy to accommodate cumulative iron plus silicon concentrations up to about 0.4 or 0.5%. Thus, the invention alloy can contain about 0.04 or 0.05 or 0.06% up to 0.15 or even 0.2 or 0.25% or 0.3% each of iron and silicon. However, a maximum of 0.1% or 0.15% or possibly 0.2% is preferred for each of iron and silicon. Elements other than those named hereinabove are preferably limited to 0.1 or 0.2% or possibly 0.3% maximum, more preferably 0.05% maximum. The combined total of other elements not named hereinabove is preferably not over 0.5 or 1%, more preferably not over about 0.1 or 0.2%.

The alloy products of this invention are typically ingot-derived and exhibit internal structure features characteristic of ingot derivation. Once an ingot has been cast into the desired composition, it is preferably homogenized by heating to one or more temperatures between about 850° and 920° or 930° F. The alloy is hot rolled typically to a suitable thickness, bearing in mind the subsequent operations. For instance, if it is desired to subsequently cold roll to 30% cold roll reduction to reach final gauge, the hot rolled gauge should be larger by a commensurate amount than the desired final gauge to allow for the 30% cold roll reduction. After hot rolling to the desired hot line gauge, preferably the alloy is subjected to a controlled thermal treatment, which is herein referred to as a controlled annealing treatment, at a temperature within the range of about 700° to 900° F., preferably within 750° to about 850° F., more preferably within about 770° or 780° to about 820° or 830° F., for instance around 800° F. for a time ranging from about 1 to 6 hours, preferably 2 to 6 hours. During this treatment, precipitate particles are grown which can control or influence the texture achieved later in cold rolling. This controlled thermal practice enhances the roll shaping formability to shape the strip into the ultimate stringer or other shape, although as explained later, there can be side effects.

After the controlled thermal treatment or anneal as just described, the alloy is cold rolled to a cold roll reduction within the range of about 15 or 20, up to about 50 or 60 or more, percent of the initial thickness. The cold rolling can be in one or more roll bite passes. Preferably, the cold rolling reduction is from about 20 to 50 or 55%, more preferably a cold reduction equivalent to cold rolling to a reduction of about 25 to 35% or 40% or 45% of the thickness of work stock entering the cold rolling operation at room temperature. It has been found that the cold working within this range enhances the ultimate cold roll shaping of the stringer or other shape, and also can help enhance resistance to edge cracking during any taper rolling that may occur prior to the roll shaping.

After cold rolling, the strip or sheet material which is typically in a thickness range of about 0.03 or 0.04 inch, for instance 0.05 or 0.06 inch, up to about 0.18 or possibly 0.2 inch or more, such as 0.21, 0.22 or 0.23 inch or more, or possibly 0.25 or even 0.3 inch, is subjected to a preferred annealing practice by heating within two temperature steps or phases. The first phase is heating within about 625° or 650° F. up to about 700° or 725° F. or possibly higher, for instance up to 750° F. or so, preferably around within 660° or 665° to about 690° or 695° F., for a period of time of about 1½ or 2 hours to about 4 hours, preferably around 2½ to 3¼ hours, preferably in a batch anneal operation.

This is followed by a second phase wherein the metal is heated within about 350° or 400° to about 500° or 550° F., preferably within about 400° to 500° F., more preferably within about 425° to 475° F., for about 2 or 3 to about 5 or 6 hours, preferably around 3½ to 4½ hours. Another preferred practice is to slowly cool or ramp down the temperature from the first anneal phase to the lower temperature second anneal phase, or alternatively to 500° F. or 400° F. or less followed by cooling further, for instance to room temperature and then heating up to the second anneal phase. That is, the preferred annealing operation following cold rolling includes a two-stage or phase annealing treatment including heating to temperatures within about 650° to 700° F. as described above, followed by controlled cooling at about 25° or 30° F. to about 50° or 60° F. per hour to one or more lower temperatures within around 400° to 500° F. as described. When referring herein to the aforesaid anneal phases or stages, such can encompass using furnace programming for the entire annealing sequence and does not necessarily require a specific hold time at any one temperature. This annealing treatment softens the metal and makes it weaker and more formable and also produces further precipitates in the metal in addition to, but smaller than, those in the metal exiting the thermal process just described above preceding cold rolling. The smaller particles will influence the response by way of strength, elongation and some other aspects during taper rolling, if used. As stated earlier, the larger precipitate particles and the texture in the metal after the earlier thermal treatment between hot and cold rolling can enhance roll shaping, but these particles and grain structures can adversely influence the taper rolling that precedes roll shaping by adversely influencing edge cracking. However, those adverse effects can be reduced by the smaller precipitate particles and grain structures formed in the aforesaid controlled anneal after cold rolling. Further, the condition after the dual-stage anneal features more or less equiaxed grains, and still further, sets the stage for proper structure in the "W" temper that follows taper rolling, if employed, and precedes the roll shaping into the stringer or other cross section so as to enhance formability in roll shaping.

The internal structure after the dual-stage anneal includes surface regions that are substantially recrystallized with grains near the surface being substantially equiaxed and exhibiting crystallographic textures which enhance roll tapering and roll shaping while the grains within inside regions remain substantially unrecrystallized which enhances SCC resistance. The surfaces and outer 0.01 or 0.02 or sometimes 0.03 inch of thickness, that is, the surface regions, are recrystallized and the inner region is generally unrecrystallized. Thin sheets, such as around 0.03 or possibly 0.04 inch thick, may have little or no unrecrystallized mid-thickness region. The recrystallized surface regions exhibit a grain size of around 100 to 1000 grains per square millimeter (g/mm) in a longitudinal cross section and cube/goss texture ratio of about 1 or greater which enhances formability. The cube grains have (100)<001> orientations whereas the goss grains have (110)<001>orientations. The cube grains favor certain kinds of formability. In general, cube textures can favor higher limit strains in deformation or forming than goss textures which, additionally, can require significantly higher loads to deform or form a metal than a cube texture. In plane strain bending, the mode that occurs in roll forming stringers, fracture normally limits the forming operation and the advantage of the cube texture is considered important because higher deformation loads associated with goss texture can often approach the critical fracture stress and lead to metal failure. On the other hand, the cube texture, or materials containing more cube than goss oriented grain don't require such high loads, thereby providing a buffer or softer zone between the lesser loads needed for forming and the critical loads that can lead to fracture. In general, keeping cold rolling below 50% or possibly 55% reduction in making the sheet and using the above-described thermal anneal treatment before cold rolling help favor the cube texture in the annealed (0 temper) sheet product. Furthermore, the particle size distributions present as the result of the preferred thermal practices herein described are desired to enhance formability while maintaining adequate resistance to edge cracking during taper rolling.

The material produced by the processing just described offers enhanced formability in the stringent subsequent forming operations to convert the cold rolled and annealed strip into stringers and other cold roll shaped forms. The sheet so produced can be split or cut into the desired width strips, which can be approximately 4 to 6 inches (or more) in width, for shaping into stringers and other elongate members. These strips can be segmented into desired lengths for making stringers. If roll tapering is employed to produce the kind of thickness profile shown in FIG. 1, the taper rolling may proceed as is currently practiced with 7075 material. It is important to remember that the cold roll tapering can reduce the thickness of the material by as much as 75 or 80% in a single pass, and that this is a serious stress on the material, and it is considered significant that the high strength material in accordance with the invention can survive this operation with relatively little edge cracking. This avoids excessive edge trim scrap and scrapped parts. The cold taper rolling is normally done with a relatively small diameter upper roll (for the upper surface in FIG. 1) which adds to the stresses put on the material. In the taper rolling, one roll can be controlled so that the metal is contoured from one side so as to vary in thickness as shown to produce the kind of shape shown in FIG. 1.

After taper rolling, if taper rolling is employed, the material is typically solution heat treated and quenched. Solution heat treating includes heating to one or more temperatures within about 840° or 850° F. to about 880° or 900° F. and takes substantial portions, preferably most or substantially all, of the soluble zinc, magnesium and copper into solution, it being understood that with physical processes, which are not always perfect, probably every last vestige of these main alloying ingredients may not be dissolved during SHT (solutionizing). More rapid heat-up rates can be preferred because such favors forming smaller and more equiaxed grains and grain textures in any recrystallization that occurs in solution heat treating so as to favor formability. Molten salt bath heating can be used to heat up rapidly. On the other hand, a slower heat-up for solutionizing can be used, such as air furnace heating, which can favor more elongated grains which are less optimal for forming but can improve SCC resistance. After heating to elevated temperatures as just described, the product should be rapidly cooled or quenched to complete the solution heat treating procedure. The cooling is typically accomplished by immersion in a suitably sized tank of cold water, although water sprays and/or air chilling may be used as supplementary or substitute cooling means. Especially since the sheet used for stringers or roll shaped sheet structural beams is relatively thin, a relatively slow quench such as a warm (for instance 150° F.) water quench can be used to favor less distortion, albeit at possibly some sacrifice in formability. After quenching, the product can be stretched for straightening or to relieve some internal stresses if desired. At this point, it is preferable to refrigerate the metal so as to reduce or minimize natural aging that would otherwise occur if the material were left at room temperature. This can be important to enhance formability for roll shaping into a desired stringer or other contour. One reason that the material is solutionized prior to the roll shaping is that if solutionizing prior to roll shaping were omitted, the final solution heat treating after roll shaping would result in more distortion than would result if solution treating occurred prior to the cold roll shaping. The material after the solution treating (the solution treating before roll shaping) is referred to as the "W" temper because it has not been permitted to naturally age at room temperature or natural aging temperature to a stable strength (that would be called a T4 temper) and, as indicated, it is preferable to quickly refrigerate the metal after solution heat treating and to maintain refrigeration until just prior to the cold roll shaping which preferably should proceed at a rapid rate from stage to stage so that natural aging effects don't carry so far as to impede the forming operation. A typical roll forming sequence is shown in FIG. 2 wherein (a) represents the initial strip which may be about 5 inches wide, it being remembered that FIG. 2 is schematic with metal thickness being depicted as a single line. The initial forming operation (which can be several operations) results in the second part of FIG. 2 depicted as (b) which is basically channel-shaped. The channel shape of (b) is then roll shaped into another intermediate shape (c) by applying roll force against the central region of the major web in the channel from stage (b). Going from stage (b) to (c) can involve more than one operation although one is shown for simplicity. The shape of (c) is then further roll shaped into the "hat" type configuration shown in (d) of FIG. 2, and the final configuration (e) is arrived at by simply curling the outer edges of the "hat" shape from (d) by further roll shaping. The roll shaping depicted in FIG. 2 is a serious degree of forming when it is remembered that the material involved is a very high strength aerospace material, especially if the material has different thicknesses along its length, such as depicted in FIG. 1. After the stringer or other member is formed as just described, it can be straightened, as necessary, if the desired beam or stringer is straight, or it can be bowed or otherwise configured along its length or curved, during roll shaping or after, as needed, to attain the final part shape or dimensional tolerance. It then can be artificially aged to develop strength and other properties for use in aircraft structures.

One preferred artificial aging practice includes heating to one or more temperatures within about 175° to about 290° F., for instance within about 230° to 270° F., such as 250° F., for about two or more hours, or more preferably for about 6 to 30 hours, followed by heating to one or more temperatures within about 300° to about 345° or 350° or possibly 360° F., or up to 400° F. for about one or two or more hours, or more preferably for about 6 to 18 hours. If desired, this sequence can be reversed such that the higher (e.g. 350° F.) temperature phase precedes the lower temperature (e.g. 250° F.) phase. This can benefit stress corrosion cracking resistance somewhat at strength levels more or less the same as the low-high sequence. This (either variant) is a relatively inexpensive practice which results in good strength, toughness and corrosion resistance performance. This type of practice is herein designated an "A" type aging practice and can be compared with T76 type practices from the standpoint of corrosion resistance. That is, the practice can produce corrosion resistance levels associated in the art with T76 temper.

It is generally known that ramping up to and/or down from given (or target) treatment temperatures, in itself, can produce precipitation (aging) or other effects which often can be, or need to be, taken into account by integrating such ramping conditions, and their precipitation hardening effects, into the total aging treatment program. Such integration was described in greater detail in U.S. Pat. No. 3,645,804, the disclosure of which is fully incorporated by reference herein. With ramping and its corresponding integration, two or three phases for thermally treating invention alloy or artificial aging practice may be effected in a single, programmable furnace. However, for convenience purposes herein, each stage (step or phase) can be described separately.

A second preferred artificial aging treatment includes subjecting the product to three main aging phases or treatments, although clear lines of demarcation may not exist between each step or phase. This aging practice is herein designated a "B" type practice. It is believed that the first stage serves to precipitation harden the alloy product; the second (higher temperature) stage then exposes alloy product to one or more elevated temperatures for increasing its resistance to exfoliation and stress corrosion cracking (SCC); while the third stage further precipitation hardens the invention alloy to a quite high strength level.

In the first treatment stage, invention alloy is precipitation hardened to strengthen it, for example, it can be carried to a point fairly near peak strength (whether underaged or possibly slightly overaged) although less than peak strength conditions (or underaging) may be desired in some cases. Such precipitation hardening can be accomplished by heating to one or more elevated temperatures below about 330° F., preferably between about 175° and 325° F., for instance around 250° F., for a significant period of time ranging from about 2 or 3 hours to about 30 hours or more. A substantially similar treatment may occur through gradual ramping to the second (higher temperature) treatment stage, with or without any hold time at temperature(s) in said first range. Such precipitation hardening significantly strengthens the alloy over the strength level which it achieves promptly after quenching (hereinafter, "as-quenched" or "solution heat treated" strength). Such precipitation hardening typically improves strengths by at least 30%, and preferably by at least 40 to 50% or more, for example, about 60 or 70%, of the difference between as-quenched strength and the strength of the product at the completion of artificial aging. In other words, the precipitation hardening of alloy product entering the second treatment (or phase) should have carried (or increased) the alloy product's yield strength by at least about 30%, and preferably more, of the way from as-quenched or solution heat treated strength (i.e., relatively low strength) toward its eventual strength after aging is completed.

Following this first phase of thermal treatment, the invention alloy is preferably subjected to heating at one or more elevated temperatures above the temperatures in the earlier stage, typically about 330° or 340° or 350° F., preferably within the range of about 340° to 400° or possibly 450° or 500° F., for a few minutes or preferably more (e.g., for 3 or more minutes, preferably more than 3 minutes, at least about 4 or 5 minutes or more). Typical second phase treatments include subjecting the alloy product to cumulative times and temperatures within the perimeter ABCD of FIG. 3, even though one, or more than one, temperature within ABCD may be employed for such treatment. Lower temperatures than 340° F., for instance 315° or 320° F., may also be useful in this treatment. As is apparent from FIG. 3, there is a correlation between time and temperature for this preferred second treatment. Generally, alloy exposure temperatures vary inversely with duration such that shorter times are used at relatively higher temperatures, while longer times are more appropriate at the lower temperatures, below about 400° F. or so. Illustrative second phase treatments proceed for 3 or more minutes between about 360° and 490° F.; for 4 or more minutes between about 360° and 480° F.; or for 5 or more minutes between about 360° and 475° F. The 3-, 4- and 5-minute minimum thresholds of ABCD in FIG. 3 are shown by lines U–V, W–X and Y–Z, respectively. In general, for a particular substantially isothermal temperature treatment, a preferred time is generally around midway between lines AB and CD in FIG. 3 for that temperature, give or take some allowance for individual circumstances.

When heating alloy products to one or more temperatures for "x" time according to herein disclosed artificial aging treatments, it is to be understood that such treatment embraces heating to any number of temperatures within said range for a cumulative time "x" above the lowest temperature of said range. As such, heating for 5 or more minutes within about 360° to 475° F. does not require holding for 5 minutes at each or even any particular temperature within said range, but rather, that the cumulative time at all temperatures within 360° to 475° F. is 5 minutes or more.

It is generally believed that the foregoing second treatment phase improves this alloy's resistance to stress corrosion cracking (SCC), exfoliation and other detrimental corrosion effects. It should be understood, however, that for some embodiments, strength also may increase during the second treatment phase depending on the extent to which the first treatment phase strengthened the alloy, especially if the alloy is significantly underaged as it enters the second phase. With respect to FIG. 3, better properties of SCC resistance are believed achievable when heating for time-temperature effects closer to line C–D, while greater combinations of strength and exfoliation resistance are attainable when aging at conditions closer to line A–B of FIG. 3. Second phase treatments may be carried out by immersing alloy products into a substantially hot liquid such as molten salt, hot oil or even molten metal. A furnace (hot air and/or other gases) may also be used depending on the size, shape and quantity of product to be treated. In the alternative, a fluidized bed-type apparatus may be used, said apparatus providing more rapid heating than a hot air furnace but slower, more uniform heating than a molten salt bath. Fluidized bed heat-ups can be especially advantageous for presenting fewer environmental complications. Induction heaters may also be used for artificial aging according to the invention, for instance, in the second phase of this preferred method.

During the third phase of this preferred treatment method, alloy product is precipitation hardened at one or more elevated temperatures up to about 330° F.; typically between about 175° and 325° F., for instance around 250° F. for about 2 to 30 hours or more.

The "B" type artificial aging treatment just described (three phases) can be designated a T77 type treatment and can result in combinations of strength and corrosion resistance better than those achieved with the "A" practice, albeit at higher cost.

EXAMPLE

Tests were performed comparing the performance of the present invention and 7075-T6, the material in wide commercial use as airplane stringer sheet. The production of the material according to the invention included hot rolling followed by heating at 800° for about 4 hours, cold rolling to a cold reduction of 30%, and then thermally treating at 675° F. for 3 hours and then slowly cooling (within around 30 to 50° F./hr) down to 450° F. and heating at 450° F. for 4 hours to produce an "0" (annealed) temper. All materials were 0.160 inch thick. The invention material was divided into portions for testing at "0" temper and for solution heat treating at 880° F. and quenching and refrigerating to provide a "W" temper for formability testing. 7075 material was also provided in "0" and "W" tempers using practices for making high formability commercial 7075 stringer sheet. All materials were initially about 0.160 inch thick but were taper rolled to 0.045 inch thick before solution heat treatment. Some invention material after solution heat treating and quenching was artificially aged at 24 hours at 250° F. followed by 8 hours at 325° F. to produce a T76 type temper. Some of the 7075 was artificially aged by heating for 24 hours at 250° F., a standard T6 treatment for 7075-T6 stringers. The materials were tested for strength and corrosion in their respective artificially aged tempers. The results of strength, SCC resistance and toughness testing are shown in Table 1 for the artificially aged condition representative of the material as used in an aircraft.

TABLE 1

| | Strength - ksi | | % | SCC① | Toughness | |
|---|---|---|---|---|---|---|
| | | | | | Kahn UPE | $K_c$(est)② |
| | Yield | Ultimate | Elong. | Resistance | in-lb/in$^2$ | ksi√in |
| Invention | 80.7 | 84.1 | 9.8 | 35 ksi | 490 | 132 |
| 7075-T6 | 74.2 | 82.5 | 13.2 | <20 ksi | 372 | 96 |

Notes for Table 1:
① SCC Resistance is the strength at which no failures occur up to 40 days in the 35% NaCl alternate immersion test; "<20 ksi" for 7075-T6 means that the specimens could not pass the test at 20 ksi. The test stresses the material in the longitudinal (rolling) direction.
② $K_c$(est) refers to fracture toughness values for 16-inch wide panels which were estimated by finite element modeling (FEM) using input from Kahn tear tests and stress-strain behavior from a tension test. Wider panels would predict higher $K_c$ values.

From the above comparison, the strength, toughness and stress corrosion cracking resistance advantages of the invention are readily seen. The 7075 could have been artificially aged to achieve better stress corrosion resistance by using the same artificial aging treatment as used for the invention material but that would have lowered ultimate and yield strengths by about 2 or 3 ksi each, or possibly more, a clear disadvantage. The resistance to exfoliation of the invention material was similar to that of 7075-T6.

Apart from strength and other properties in the artificial aged condition, the workability in the "0" and "W" conditions is also important. In taper rolling the invention material in "0" condition performed roughly about the same as 7075-0, essentially no edge cracks.

In roll shaping in the "W" temper using a roll forming operation previously used for 7075-W to make stringers, the invention material showed no disadvantages over 7075. It should be remembered that the particular stringer forming operation was based on a sequence designed for 7075-W and the performance of the invention material was not tested to its capability which is believed to be higher than 7075-W based on more stringent tests such as shown in the following Table 2.

TABLE 2

| | Invention | | 7075 | |
|---|---|---|---|---|
| | 0 | W | 0 | W |
| guided bend test min. r/t | 0.192 | 0.598 | 1.23 | 1.1 |
| uniform elongation | 14% | 26.9% | 10.6% | 18.4% |
| tensile elongation | 21.5% | 28% | 18.5% | 19.4% |

Figure 4A:
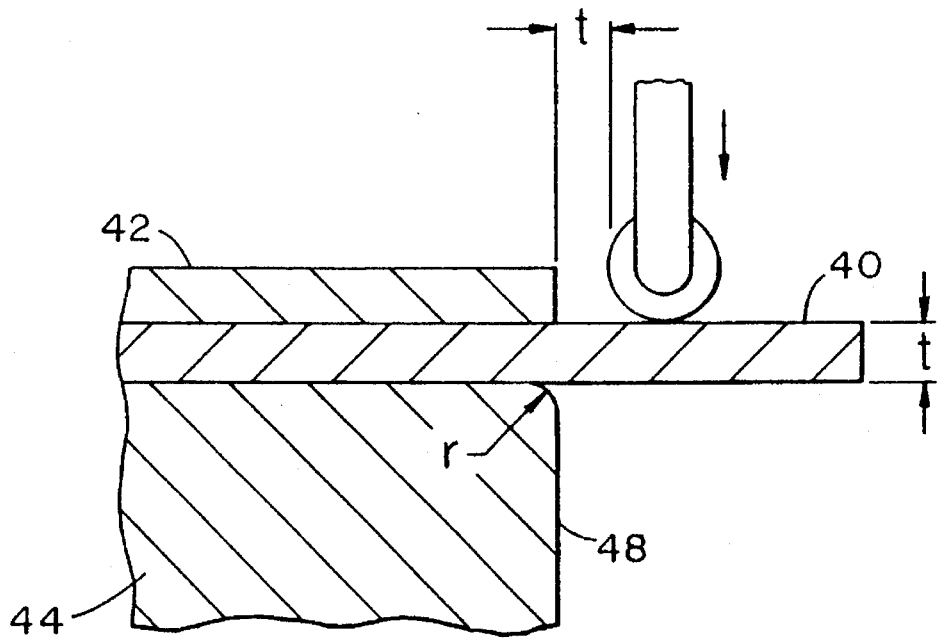
FIG. 4(*a*) and 4(*b*) is a schematic illustration of a guided bend formability test.
Figure 4B:
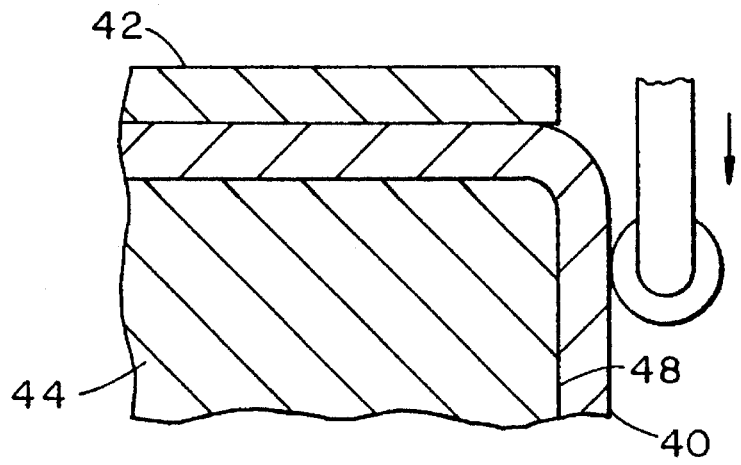

In the guided bend test the sheet is rolled over a comer to make a 90° bend in the sheet. The sheet tested was 0.160 inch thick and was not prestrained before the bend test which bent the sheet transverse to the rolling direction (bend axis perpendicular to rolling direction). The guided bend test referred to is schematically shown in FIG. 4 wherein the test sheet 40 having thickness t is clamped by pressure plate 42 against the upper face of die 44 having a corner radius r. FIG. 4(*a*) shows the arrangement before bending. Roller 46 has a diameter of 1 inch and has its roll face displaced from die vertical face 48 by a gap corresponding to the sheet thickness t. Moving the roller down as shown in FIG. 4(*b*) bends the sheet as shown. This test is considered more meaningful than a free bend test because it is considered to correspond closer to actual production forming modes used in making aircraft stringers. The minimum radius that can be bent without cracking divided by the metal thickness is shown in the table above. For the guided bend test, a lower figure correlates with better formability since lesser values mean that material can be bent over a smaller radius which produces higher stresses near the surface of the test piece. For elongation, a higher figure generally correlates with better formability. The formability advantage of the invention is apparent from the above table, and in these stringent tests the invention material is believed to offer more robustness in the forming process such that more severe roll forming or shaping could be performed than with 7075-W. In another test, the alloy in accordance with the invention was processed differently than set forth above in this example. The metal was hot rolled and then cold rolled to a 30% thickness reduction, without an intervening thermal treatment, followed by annealing at about 775° F. for around 3 hours and cooling to 450° F. and holding at about 450° F. for about 4 hours to produce "0" temper sheet. This sheet edge cracked substantially in taper rolling. Its guided bend test performance was also inferior to the invention material, over 0.8 in 0-temper and over 0.7 in W-temper, a performance level clearly less desirable than the invention material in Table 2, especially as to the 0-temper.

The invention material in 0 temper exhibits a minimum guided bend test r/t of about 0.2 or 0.3, less preferably around 0.4 or 0.5 in 0 temper, and in W temper a minimum r/t of about 0.7 or 0.8, less preferably about 0.85. The invention material in 0 temper has a minimum uniform elongation of about 11 or 12% and in W temper of about 21 or 22%, preferably 23 or 24%. The invention material in 0 temper has a minimum tensile elongation of about 18%, preferably 19% or 20%, and in W temper of about 22 or 23%, preferably 24%. Artificially aged stringers in accordance with the invention can have a guaranteed minimum yield strength of 72 or 73 ksi, preferably 74 ksi, more preferably 75 ksi or more, whereas 7075-T6 minimum guaranteed strength level is about 68 or 69 ksi. Artificially aged stringers in accordance with the invention can have a guaranteed minimum tensile (ultimate) strength of 80 or 81 or preferably 82 ksi, whereas 7075-T6 minimum guaranteed tensile strength is about 78 ksi. Thus, the strength of the invention stringers is more than equal to 7075-T6, it is superior. Moreover, this strength is combined with better SCC resistance and better toughness so as to enable making a superior stringer. The minimum L-T orientation fracture toughness $K_c$ for the invention sheet or stringer is about 100 ksi$\sqrt{\text{in}}$, preferably 110 ksi$\sqrt{\text{in}}$ for a 16-inch wide test panel about 0.045 inch thick, which is considered a clear advantage over 7075-T6. The SCC resistance for the invention sheet in a longitudinal stress permits a guaranteeable threshold stress (up to 40 days in a 3.5% sodium chloride alternate immersion test without failure) of about 30 to 35 ksi which is considered good SCC resistance. Moreover, in the "0" and "W" tempers used for actually taper rolling and roll shaping the stringers, the invention stringer sheet forms better than 7075 in those tempers including 7075 made by procedures to improve forming, such as commercial 7075 stringer sheet.

When referring to a minimum (for instance for strength), such refers to a level at which specifications for materials can be written or a level at which a material can be guaranteed or a level that a user (subject to safety factor) can rely on in design. In some cases, it can have a statistical basis wherein 99% of the product conforms or is expected to conform with 95% confidence using standard statistical methods. As shown above, typical strength and other properties for invention sheet are higher than the minimum or guaranteeable levels set forth.

Unless indicated otherwise, the following definitions apply herein:

a. The term "ksi" is equivalent to kilopounds (1000 pounds) per square inch.

b. Percentages for a composition refer to % by weight.

c. The term "ingot-derived" means solidified from liquid metal by a known or subsequently developed casting process rather than through powder metallurgy techniques. This term shall include, but not be limited to, direct chill casting, electromagnetic casting, spray casting and any variations thereof.

d. In stating a numerical range or a minimum or a maximum for an element of a composition or a temperature, time or other process matter or a property or an extent of improvement or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. For example, a range of 7.6 to 8.4% zinc expressly specifically discloses zinc contents of 7.7, 7.8, 7.9% . . . and so on, up to about 8.4% zinc. Similarly, herein disclosing artificial aging to one or more temperatures between about 300° and 345° F.

specifically discloses 301°, 302° F.. . . 315°, 316° F., . . . and so on, up to the stated maximum. Designating up to 0.25% or 0.25% maximum discloses 0.01, 0.02 . . . 0.1, 0.15 . . . up to 0.25%.

Having described the presently preferred embodiments, it is to be understood that the invention may be otherwise embodied within the scope of the appended claims.

What is claimed is:

1. The method of producing an aerospace elongate structural shape cross section comprising:

(a) providing aluminum alloy consisting essentially of about 7.6 to 8.4% zinc, about 1.8 to 2.2% magnesium, about 2 to 2.6% copper, at least one element selected from zirconium, vanadium and hafnium present in a total amount not exceeding about 0.5% the balance substantially aluminum and incidental elements and impurities;

(b) hot rolling said alloy;

(c) subjecting said alloy to a thermal treatment within about 700° to 900° F.;

(d) cold rolling said alloy to a reduction in thickness of from about 20 to about 70%;

(e) subjecting said alloy to a thermal treatment anneal comprising:

(i) subjecting said alloy to temperatures within about 625° to 750° F. for about 2 or more hours; and then (ii) subjecting said alloy to temperatures within about 350° to 550° F. for about 2 or more hours;

thereby to produce a strip product; and (f) shaping said strip product to provide an elongate structural shape cross section.

2. The method according to claim 1 wherein prior to (f) of claim 1 the workable strip product, or a portion thereof, is cold worked to selectively reduce the thickness thereof at portions along its length to produce an elongate varied thickness strip having different thickness along its length.

3. The method according to claim 1 wherein prior to (f) of claim 1 the workable strip product, or a portion thereof, is cold worked to selectively reduce the thickness thereof at portions along its length to produce an elongate varied thickness strip having different thickness along its length and said varied thickness strip is solution heat treated and quenched.

4. The method according to claim 1 wherein said cold rolling of (d) reduces the thickness by about 20 to 50%.

5. The method according to claim 1 wherein said (e)(i) extends for about 2 to 4 hours.

6. The method according to claim 1 wherein said (e)(ii) extends for about 2½ to 4 hours.

7. The method according to claim 1 wherein said (c) extends for about 2 to 6 hours.

8. The method according to claim 1 wherein said (c) is within about 750° to 850° F.

9. The method according to claim 1 wherein said (c) is within about 770° to 830° F.

10. The method according to claim 1 wherein said (c) is within about 750° to 850° F. for about 2 to 6 hours.

11. The method according to claim 1 wherein said (e)(i) is within 650° to 725° F.

12. The method according to claim 1 wherein said (e)(i) is within 650° to 695° F.

13. The method according to claim 1 wherein said (e)(ii) is within 400° to 500° F.

14. The method according to claim 1 wherein said (e)(ii) is within 425° to 475° F.

15. The method according to claim 1 wherein between (e)(i) and (e)(ii) the alloy is cooled at a rate of about 20° to 70° F. per hour to about 500° F. or less.

16. The method of producing an aerospace elongate structural shape cross section comprising:

(a) providing aluminum alloy consisting essentially of about 7.6 to 8.4% zinc, about 1.8 to 2.2% magnesium, about 2 to 2.6% copper, at least one element selected from zirconium, vanadium and hafnium present in a total amount not exceeding about 0.5%, the balance substantially aluminum and incidental elements and impurities;

(b) hot rolling said alloy;

(c) subjecting said alloy to a thermal treatment within about 750° to 850° F. for a time of 2 to 6 hours;

(d) cold rolling said alloy to a reduction in thickness of from about 20 to about 40%;

(e) subjecting said alloy to a thermal treatment anneal comprising:

(i) subjecting said alloy to temperatures within about 625° to 695° F.; and then (ii) cooling at a rate of about 20° to 70° F. per hour to around 500° F. or less; and (iii) subjecting said alloy to temperatures within about 400° to 500° F.;

thereby to produce a workable strip product;

(f) solution heat treating and quenching strip product; and (g) roll shaping said strip product to provide an elongate structural shape cross section.

17. The method according to claim 16 wherein the strip is refrigerated between solution heat treating and shaping into the structural shape cross section.

18. The method according to claim 16 wherein said structural shape is artificially aged by heating within about 175° to about 290° F. for about 2 hours or more and heating within about 300° to about 400° F.

19. The method according to claim 16 wherein said structural shape is artificially aged by heating within about 300° to about 400° F. and heating within about 175° to about 290° F. for about 2 hours or more.

20. The method according to claim 16 wherein said structural shape is artificially aged by heating within about 175° to about 325° F. for about 2 hours or more, thereafter heating within about 330° to 400° F., and thereafter heating within about 175° to about 325° F. for about 2 hours or more.

21. The method according to claim 16 wherein before (e)(iii) the alloy is cooled essentially to room temperature.

22. The method of producing an aerospace elongate structural shape cross section comprising:

(a) providing aluminum alloy consisting essentially of about 7.6 to 8.4% zinc, about 1.8 to 2.2% magnesium, about 2 to 2.6% copper, about 0.05 to 0.25% zirconium, the balance substantially aluminum and incidental elements and impurities;

(b) homogenizing said alloy;

(c) hot rolling said alloy;

(d) subjecting said alloy to a thermal treatment within about 750° to 850° F. for a time of 2 to 6 hours;

(e) cold rolling said alloy to a reduction in thickness of from about 20 to about 40%;

(f) subjecting said alloy to a thermal treatment anneal comprising:

(i) subjecting said alloy to temperatures within about 625° to 725° F. for about 2 to 4 hours; and then (ii) cooling at a rate of about 20° to 70° F. per hour to around 500° F. or less; and (iii) subjecting said alloy to temperatures within about 400° to 500° F. for about 2 to 6 hours;

thereby to produce a workable strip product;

(g) cold working the elongate workable strip product, or a portion thereof, to selectively reduce the thickness thereof at portions of its length to produce an elongate varied thickness strip product having different thicknesses at different parts of its length;

(h) solution heat treating and quenching said varied thickness strip product; and (i) roll shaping said strip product to provide an elongate structural shape cross section.

23. In a method of producing a roll shaped elongate structural shape from aluminum alloy strip wherein aluminum alloy strip is solution heat treated, quenched and roll shaped into an elongate structural shape section which is thereafter artificially aged, the improvement wherein said aluminum alloy strip is provided by a method comprising:

(a) providing aluminum alloy consisting essentially of about 7.6 to 8.4% zinc, about 1.8 to 2.2% magnesium, about 2 to 2.6% copper, about 0.05 to 0.25% zirconium, the balance substantially aluminum and incidental elements and impurities;

(b) hot rolling said alloy;

(c) subjecting said alloy to a thermal treatment within about 700° to 900° F.;

(d) cold rolling said alloy to a reduction in thickness of from about 20 to about 70%; and (e) subjecting said alloy to a thermal treatment anneal comprising:

(i) subjecting said alloy to temperatures within about 625° to 740° F.; and (ii) subjecting said alloy to temperatures within about 400° to 500° F.;

thereby to produce a workable strip product.

24. In a method of producing a roll shaped elongate structural shape from aluminum alloy strip wherein aluminum alloy strip is solution heat treated, quenched and roll shaped into an elongate structural shape section which is artificially aged, the improvement wherein said aluminum alloy strip is provided by a method comprising:

(a) providing aluminum alloy consisting essentially of about 7.6 to 8.4% zinc, about 1.8 to 2.2% magnesium, about 2 to 2.6% copper, and at least one element selected from zirconium, vanadium and hafnium present in a total amount not exceeding about 0.5% the balance substantially aluminum and incidental elements and impurities;

(b) hot rolling said alloy;

(c) subjecting said alloy to a thermal treatment within about 700° to 900° F. for a time of 2 or more hours;

(d) cold rolling said alloy to a reduction in thickness of from about 20 to about 70%; and (e) subjecting said alloy to a thermal treatment anneal comprising:

(i) subjecting said alloy to temperatures within about 625° to 725° F. for about 2 or more hours; and then (ii) subjecting said alloy to temperatures within about 400° to 500° F. for about 2 or more hours;

thereby to produce a workable strip product.

25. An improved roll shapable annealed aluminum alloy sheet product of an alloy consisting essentially of about 7.6 to 8.4% zinc, about 1.8 to 2.2% magnesium, about 2 to 2.6% copper, at least one element selected from zirconium, vanadium and hafnium present in a total amount not exceeding about 0.5%, the balance substantially aluminum and incidental elements and impurities, said product ranging from about 0.03 to 0.25 inch thick, said sheet in annealed 0 temper having a minimum tensile elongation of about 18%, a minimum uniform elongation of about 11%, a minimum r/t in a guided bend test of about 0.5 or less, and further having a recrystallized grain texture in the sheet surface regions extending about 0.01 inch or more into the metal, the recrystallized grains having a cube:goss ratio greater than 1 and a grain size of 100 grains/mm$^2$ or finer in a longitudinal cross section.

26. The product according to claim 25 wherein said sheet in 0 temper has a minimum tensile elongation of 20%.

27. The product according to claim 25 wherein after artificial aging the product has a minimum yield strength of 74 ksi, a minimum tensile strength of 80 ksi and a minimum L-T fracture toughness $K_c$ of 100 ksi$\sqrt{\ }$ in in a 16-inch wide panel test and further having a stress corrosion resistance of 30 ksi minimum.

28. The product according to claim 25 wherein after artificial aging the minimum yield strength is at least 75 ksi and the minimum tensile strength is at least 82 ksi.

29. The product according to claim 25 which is solution heat treated and quenched to provide W temper material having a minimum tensile elongation of about 22%, a minimum uniform elongation of about 21%, a minimum r/t in a guided bend test of about 0.9.

* * * * *